United States Patent [19]

Blaschke

[11] 4,306,296

[45] Dec. 15, 1981

[54] CONVERTER FOR CHANGING CARTESIAN VECTOR VARIABLES INTO POLAR VECTOR VARIABLES

[75] Inventor: Felix Blaschke, Erlangen, Fed. Rep. of Germany

[73] Assignee: Siemens Aktiengesellschaft, Munich, Fed. Rep. of Germany

[21] Appl. No.: 22,483

[22] Filed: Mar. 21, 1979

[30] Foreign Application Priority Data

Apr. 7, 1978 [DE] Fed. Rep. of Germany ..... 2816661

[51] Int. Cl.[3] ..... G06G 7/22

[52] U.S. Cl. ..... 364/815; 364/851

[58] Field of Search ..... 364/815, 817, 818, 851, 364/729, 731

[56] References Cited

U.S. PATENT DOCUMENTS

| | | | |
|---|---|---|---|
| 2,634,909 | 4/1953 | Lehman | 364/815 |
| 2,763,430 | 9/1956 | Gray | 364/815 |
| 2,927,734 | 3/1960 | Vance | 364/818 |
| 2,996,251 | 8/1961 | Hunt | 364/815 |
| 3,371,199 | 2/1968 | Schwartzenberg et al. | 364/815 |
| 3,710,088 | 1/1973 | Blaschke et al. | 364/815 |
| 3,737,639 | 6/1973 | Fletcher et al. | 364/817 |
| 3,825,738 | 7/1974 | Blaschke et al. | 364/815 |

FOREIGN PATENT DOCUMENTS 1336237 11/1973 United Kingdom .

*Primary Examiner*—Felix D. Gruber
*Attorney, Agent, or Firm*—Kenyon & Kenyon

[57] ABSTRACT

A coordinate converter useful for field-oriented control of a rotating-field machine includes a divider, a first adder, a multiplier and a second adder by which the magnitude of the vector and the tangent of the half-angle relative to one axis can be determined. An ancillary unit forms an angle-proportional variable from the half-angle tangent. A rotating vector can also be processed.

18 Claims, 13 Drawing Figures

CONVERTER FOR CHANGING CARTESIAN VECTOR VARIABLES INTO POLAR VECTOR VARIABLES

BACKGROUND OF THE INVENTION

1. Field of the Invention

This invention relates to a converter for changing first and second given variables, corresponding to the Cartesian coordinates of a vector, into at least one variable corresponding to the angle coordinate of the vector, represented in polar coordinates.

2. Discussion of the Prior Art

A coordinate converter for changing Cartesian vector variables into polar vector variables is needed for various purposes, e.g., for the field-oriented control of a rotating machine. To date, the computing modules available for the processing of vector variables are the vector analyzer and the vector rotator shown in German Pat. No. 1,941,312, FIGS. 5 and 6, restrictively. These computing modules are suited for the processing of rotating and nonrotating vectors. They require relatively elaborate equipment.

FIG. 16 of the brochure, "IC Programmable Multiplier Divider Computation Circuit", by Analog Devices, Norwood, Mass. (USA) shows a coordinate converter which makes it possible to compute, from a first and a second given variable, a1 and a2, respectively, which correspond to the Cartesian coordinates of a vector, the magnitude a of this vector. There, the derived magnitude corresponds to the magnitude coordinate of the vector described by polar coordinates. No provision is made for calculating the angle coordinate. This existing coordinate converter comprises an integrated module, designated AD 531, which forms an output variable $(a1)^2/c$ from the first variable a1 and from another variable c. The variable c is furnished by a first adder to which the second variable a2 and the magnitude a are supplied. The magnitude a, in turn, is taken from the output of the coordinate converter via a feedback line. The output variable $(a1)^2c$ of the integrated module is fed to a second adder to which the second variable a2 is also applied. Its output variable is the desired vector magnitude a. It is available at the coordinate converter output for further processing. As already mentioned, this coordinate converter is not suited for furnishing an output variable corresponding to the angle coordinate of the vector. In addition, its function is restricted, in that the sign of the second input variable a2 must be positive only.

It is an object of the present invention to provide a coordinate converter of the kind described at the outset for the processing of a vector which is characterized by its simplicity of circuitry and which provides, therefore, for computation of at least the angle coordinate from the Cartesian coordinates of a given vector.

BRIEF DESCRIPTION OF THE INVENTION

In accordance with the present invention, the above problem is solved in a preferred embodiment by means of a divider, a first adder, a multiplier and a second adder. The second variable is supplied to the dividend input of the divider and the output variable of the first adder is supplied to the divisor input of the divider. The first variable and the output variable of the second adder are applied to the first adder and the output variable of the divider is taken off as a third variable, on the one hand, and fed to the input of the multiplier, on the other hand. The second variable is supplied to the other input of the multiplier and the first variable and the output variable of the multiplier are supplied to the second adder. The output of the second adder is taken off as a fourth variable, corresponding to the magnitude coordinate of the vector represented by the polar coordinates.

According to the invention, this coordinate converter represents a basic unit. It forms, from the Cartesian coordinates of a vector, the magnitude and the tangent of half the angle as an angle like variable. With such a K/PT converter (K for "Kartesian", PT for "polar-tangent"), which is of very simple construction, certain problems are immediately and satisfactorily soluble. Its operating range lies between +90° and −90°.

To extend the operating range, the second variable may be supplied to the dividend input of the divider via a first proportional element and the output variable of the multiplier to the second adder via a second proportional element. By modifying the coordinate converter by means of these proportional elements, the working range can be increased to extend from +130° to −130°.

For problems where the point is not the generation of an angle-like variable, but reproducing the angle as accurately as possible, the basic unit may be supplemented by an ancillary apparatus which determines a fifth variable from the half-angle tangent mentioned; this fifth variable will simulate the angle to approximately ±0.5°. It is a feature of the ancillary unit that the third variable is fed, via a third proportional element, to the first input of a third adder. The output of another divider is applied to the input of the adder via a fourth proportional element. The second variable is applied to the dividend input of this other divider and the output of a fourth adder is applied to the divisor input. The fourth variable and, via a fifth proportional element, the first variable also are supplied to the fourth adder and the fifth variable is taken off at the output of the third adder.

In a second embodiment of the invention, for the case where the magnitude coordinate of the vector described in polar coordinates is constant, a divider, a first adder, another adder, as well as a first and two additional proportional elements are provided. The second variable is supplied to the dividend input of the divider via the first proportional element and the output variable of the first adder is fed to the divisor input of the divider. The first variable and a constant quantity are supplied to the first adder. The output variable of the divider is supplied, via one of the additional proportional elements, and a variable derived from the second variable is supplied, via the other of the additional proportional elements, to the other adder. The output variable of the other adder is taken off as the angular variable.

The coordinate converters mentioned so far are suited only for the processing of a nonrotating vector. In order for a rotating vector to be computable, the first variable is taken off the output of a rectifier to which a preset, bipolar first variable is applied.

The coordinate converter of the present invention is an analog computer suitable for the processing of nonrotating and rotating vectors, expressed, in particular, in the field coordinate system used in connection with the field-oriented control of a rotating-field machine. Compared to the previously known vector analyzer and vector rotator, it requires fewer and simple components. Compared to the coordinate converter described in the Analog Devices brochure, mentioned above, it is a feature of the first embodiment of the invention that the function of the integrated module (formation of the output variable $(a1)^2/c$) is accomplished by separate components, namely by the divider and the multiplier, with the mutliplier succeeding the divider. This also makes it possible to determine, at practically no extra cost, the third variable corresponding to the angle coordinate, in addition to the magnitude coordinate corresponding to the fourth variable. Due to the separation of the dividing function and the multiplying function, the circuit designer now need not depend on one special integrated module.

DETAILED DESCRIPTION OF THE INVENTION

Figure 1:
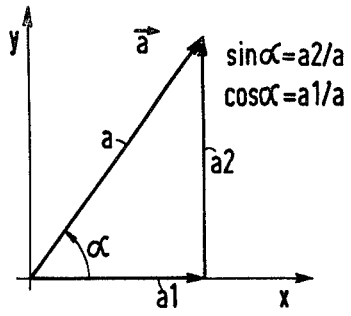
FIG. 1 shows how a vector is described in the biaxial Cartesian and in the polar coordinate systems.

In the drawing of FIG. 1 two variables a1 and a2 are shown, corresponding to the Cartesian coordinates of a vector $\vec{a}$ in a Cartesian coordinate system having the two coordinate axes, x and y. The two variables here represent, in particular, two analog electrical variables such as the components of magnetic flux required for the field-oriented control of a rotating-field machine. At the same time, the vector $\vec{a}$ is fixed in a polar coordinate system by the angle coordinate $\alpha$ and by the coordinate magnitude a. The angle coordinate $\alpha$ describes the angle between the vector $\vec{a}$ and the coordinate axis x. The first problem which arises is to compute from the first and second variable a1 and a2 a third and a fourth variable which are a measure of the angle coordinate $\alpha$ and the magnitude coordinate a, respectively. In what follows, the (electrical) variables will have the same designation as the corresponding components of the vector $\vec{a}$.

The coordinate converter described hereinafter is an analog computer circuit based on the known relations $$\tan \alpha/2 = \sin \alpha/(1+\cos \alpha) \quad (1)$$

and $$\tan \alpha/2 = (1-\cos \alpha)/\sin \alpha \quad (2)$$

By expanding these relations (1) and (2) by the magnitude a, the relations $$\tan \alpha/2 = a2/(a+a1) \quad (3)$$

and $$\tan \alpha/2 = (a-a1)/a2 \quad (4)$$

are obtained, taking into consideration the relations $\sin \alpha = a2/a$ and $\cos \alpha = a1/a$.

By transposition, the magnitude a is obtained as $$a = a2 \cdot \tan \alpha/2 + a1 \quad (5)$$

from Equation (4).

The procedure now is that the variable $\tan \alpha/2$ is formed first according to Equation (3), the still unknown magnitude a being assumed as known and taken off at the output of the coordinate converter. From this result for $\tan \alpha/2$, one obtains the magnitude a from Equation (5) and inserts it into Equation (3). The coordinate converter 20*a* shown in FIG. 2, which is provided for the coordinate conversion when a non-rotating vector is involved, is based on Equations (3) and (5).

Figure 2:
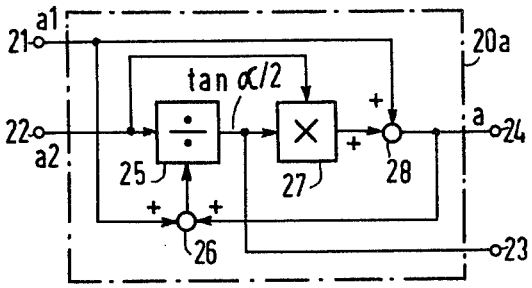
FIG. 2 is a block diagram of an embodiment of a particularly simple coordinate converter according to the teachings of the invention.

According to FIG. 2, a first variable a1 is fed to a first input terminal 21 of the coordinate converter 20*a* and second variable a2, to a second input terminal 22. The first variable may only be positive (such as in the range from 0 to 10 V); the second variable a2 may be of either polarity (such as in the range from −10 V to +10 V). The third variable $\tan \alpha/2$ and the fourth variable a are taken off at output terminals 23 and 24, respectively. Coordinate converter 20*a* contains a divider 25, a first adder 26, a multiplier 27, and a second adder 28, connected as shown. The third variable, $\tan \alpha/2$ of Equation (3), is formed by means of divider 25 and first adder 26. For this purpose, the second variable a2 is applied to the dividend input and the output variable of first adder 26 to the divisor input of dividend 25. The first variable a1 and the fourth variable a taken from output terminal 24 are fed to the input terminals of first adder 26. The output variable $\tan \alpha/2$ of divider 25 is passed on via two paths, being connected, on the one hand, to output terminal 23 where it is available for further processing, and, on the other hand, to one input of multiplier 27. The second variable a2 is applied to the other input of multiplier 27. The output of multiplier 27 is fed to second adder 28 which is also fed the first variable a1. The output variable of second adder 28 is, in turn, connected to output terminal 24 as the fourth variable a. In the circuit shown, multiplier 27 and second adder 28 realize Equation (5).

The coordinate converter 20*a* shown in FIG. 2 is of particularly simple design. Requiring only a few components, it furnishes the two variables $\tan \alpha/2$ and a at the same time.

It is noteworthy that, if the variables a1 and a2 are interchanged at input terminals 21 and 22, the third variable tan $\alpha/2$ will be the complementary angle $(90°-\alpha)$—provided that the coordinates of FIG. 1 are retained. This angle, too, may be of interest for further processing, upon occasion. The interchange does not affect the determination of the fourth variable.

Circuit elements 25 to 28 may comprise appropriately connected operational amplifiers, as will be understood by those skilled in the art. The outputs of the integrated circuits, however, must lie only in an appropriate operating range, of which the upper limit is, say, 10 V. Since the individual output variables must generally not exceed this limit, which is normalized to 1 in the following analysis, the computing range of coordinate converter 20*a*, just shown, covers only a range from $-1$ to $+1$ with respect to the third variable tan $\alpha/2$; i.e., the angle $\alpha$ covers a range from $-90°$ to $+90°$. But by applying the value K tan $\alpha/2$, with a constant $K<1$, instead of the value tan $\alpha/2$ to output terminal 23, the computation range can be expanded to $$-1/K \leqq \tan \alpha/2 \leqq +1/K \quad (6).$$

By way of example, this results in an angular range of $-126°$ to $+126°$ for the angle $\alpha$ at $K=0.5$ and an angular range of $-143°$ to $+143°$ for $K=0.33$.

Equations (3) and (5) thus generalized read:

$$K \tan \alpha/2 = K\ a2/(a+a1) \quad (3a)$$

$$a = K \tan \alpha/2\ a2/k + a1 \quad (5a).$$

Figure 3:
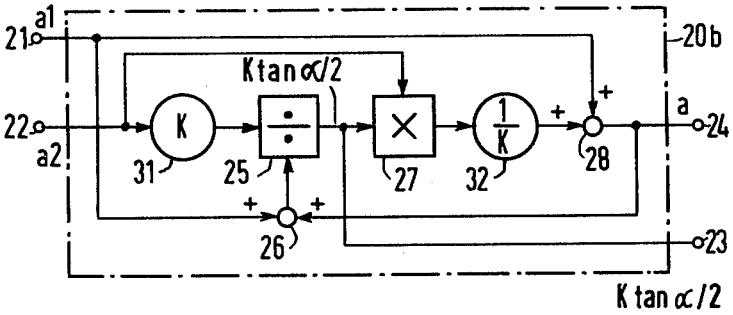
FIG. 3 is a block diagram of another embodiment of the coordinate converter of FIG. 1 which has extended operating range.

The equations (3*a*) and (5*a*) are implemented into the coordinate converter 20*b* shown in FIG. 3. It differs from coordinate converter 20*a* of FIG. 2 in that it is provided with first and second proportional elements 31 and 32, respectively. Proportional element 31 directly precedes the dividend input of divider 25, and proportional element 32 lies between the output of multiplier 27 and one input of second adder 28. The proportionality constant of first proportional element 31 is K, and the proportionality constant of second proportional element 32 is 1/K.

Figure 4:
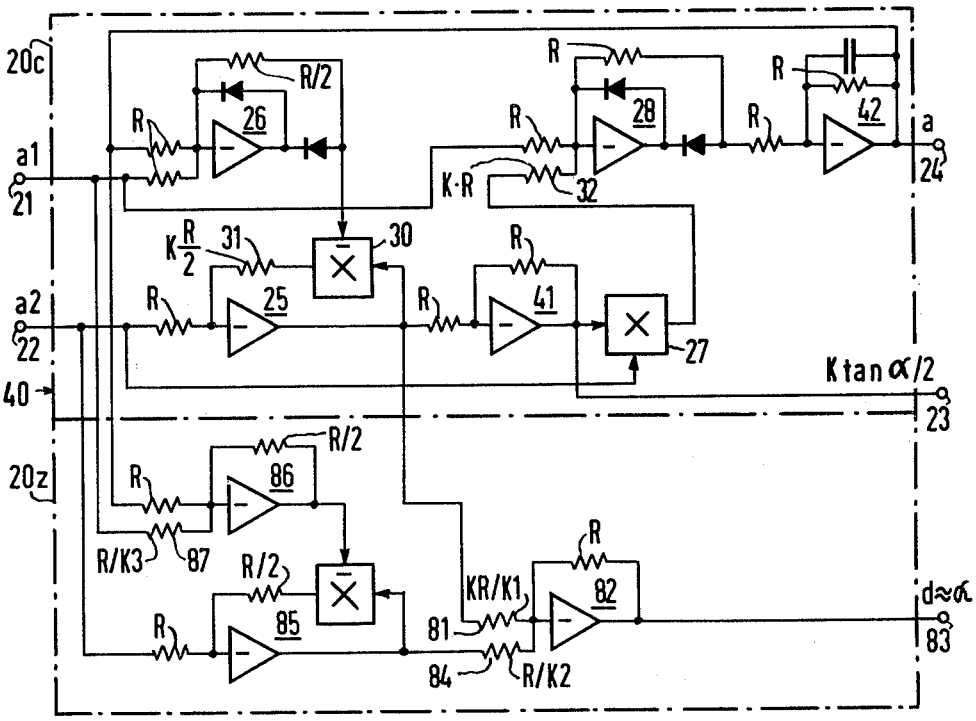
FIG. 4 is a schematic diagram of a coordinate converter consisting of the basic unit and an ancillary unit like that of FIG. 8.

One circuit design for a coordinate converter 20*b* is shown in FIG. 4 as coordinate converter 20*c* which is the basic unit, and an associated ancillary unit 20*z*. Ancillary unit 20*z* will be explained later.

As may be seen in FIG. 4, coordinate converter 20*c* uses appropriately connected operational amplifiers. The various functional units have the same reference symbols as the blocks in FIG. 3. The indicated proportion of each individual ohmic resistor is based on a unit value R, which may be 20 kOhm, for instance, as will be understood by those skilled in the art.

Divider 25 and first proportional element 31 are made up of an operational amplifier having a multiplier 30 and a resistor connected in series in the feedback path. Multiplier 30 has a reversing second input for changing the sign of the received signal. The resistor in the feedback path serves as first proportional element 31; its resistance is selected, in accordance with the desired proportionality constant K, as K·R/2.

Adders 26 and 28 are also appropriately connected operational amplifiers. It is worth mentioning here that the series resistor located between the output of multiplier 27 and the input of second adder 28 serves as second proportional element 32; it has the resistance value KR—according to the desired proportionality constant 1/K.

Phase-inverting amplifier 41 is inserted between divider 25 and multiplier 27 for signal processing. For the same purpose, another phase-inverter amplifier 42 is inserted between the output of second adder 28 and output terminal 24. A smoothing capacitor is provided in the feedback circuit to ensure stable operation.

By using two coordinate converters of the type shown in FIG. 3 it is possible to determine the magnitudes a, b, and the angular difference $(\alpha-\beta)$ of two nonrotating vectors, $\vec{a}, \vec{b}$ from the corresponding Cartesian components a1, a2 and b1, b2, respectively. This is explained below with reference to FIGS. 5 and 6.

Figure 5:
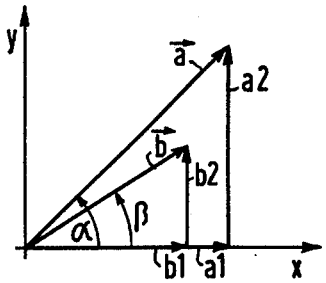
FIG. 5 illustrates two vectors in the Cartesian and polar coordinate systems.
Figure 6:
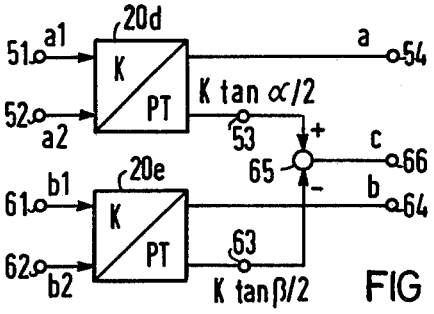
FIG. 6 is a block diagram illustrating an interconnection of two coordinate converters.

FIG. 5 shows the Cartesian and the polar coordinates of two vectors $\vec{a}$ and $\vec{b}$. According to FIG. 6, two coordinate converters 20*d* and 20*e*, designed like the coordinate converter 20*b* in FIG. 3 are provided, the first and second variable a1 and a2, respectively, are applied to the input terminals 61 and 62 of the coordinate converter 20*e* the first and second variable b1 and b2, respectively to the input terminals 51 and 52 of the coordinate converter 20*d*. As described in connection with FIG. 3, the magnitudes a and b can be taken off at output terminals 54 and 64, respectively. The variable K·tan $\alpha/2$ appears at output terminal 53 of coordinate converter 20*d*, and the variable K·tan $\beta/2$ appears at output terminal 63 of the other coordinate converter 20*e*. Both of these variables are supplied to a subtractor 65. The difference is taken and the output variable c is taken off at terminal 66 of subtractor 65.

By forming the difference, the resultant output variable c is:

$$c = K(\tan \alpha/2 - \tan\beta/2) \quad (7)$$

$$= K \tan(\alpha/2 - \beta/2)(1 + \tan\alpha/2 \tan\beta/2). \quad (8)$$

If the angle $\alpha$ represents an actual value, and the angle $\beta$, a reference value, then $$|\alpha-\beta| << 1 \quad (9)$$

Therefore, since the difference between the reference and the actual value varies around zero, the nonlinearity of the tangent functions may be neglected with good approximation.

Considering this condition, $$c = 0.5K(\alpha-\beta)(1+\tan \alpha/2 \cdot \tan \beta/2) \quad (10).$$

The second term in parentheses represents an amplification factor which depends on the absolute size of the angles $\alpha$ and $\beta$. This amplification factor leads to increasing amplification of the difference between the reference and actual value for larger angles $\alpha,\beta$. The resultant multiplication factor for $\alpha=\beta=90°$ is 2. This doubling of the output variable c is not of importance in many cases.

As is known, the variable tan $\alpha/2$ is proportional to the angle $\alpha$ with good approximation in a rather wide range. The third variable tan $\alpha/2$ and K tan $\alpha/2$ of the coordinate converters 20*a* and 20*b* shown in FIGS. 2 and 3, respectively, can, therefore, be viewed as a direct measure of the angle $\alpha$. For the case where the nonlinearity of the function tan $\alpha/2$ is not permissible, the K/PT converter 20*a* or 20*b* shown in FIGS. 2 and 3, respectively, can be expanded into a true K/P converter which furnishes a variable d proportional to the angle $\alpha$.

The objection of the following is, therefore, to obtain a quantity d which is to a large extent proportional to the angle $\alpha$. The relation $$d = K1 \cdot \tan \alpha/2 + K2a2/(a + K3a1) \quad (11)$$

is used for this purpose.

Figure 7:
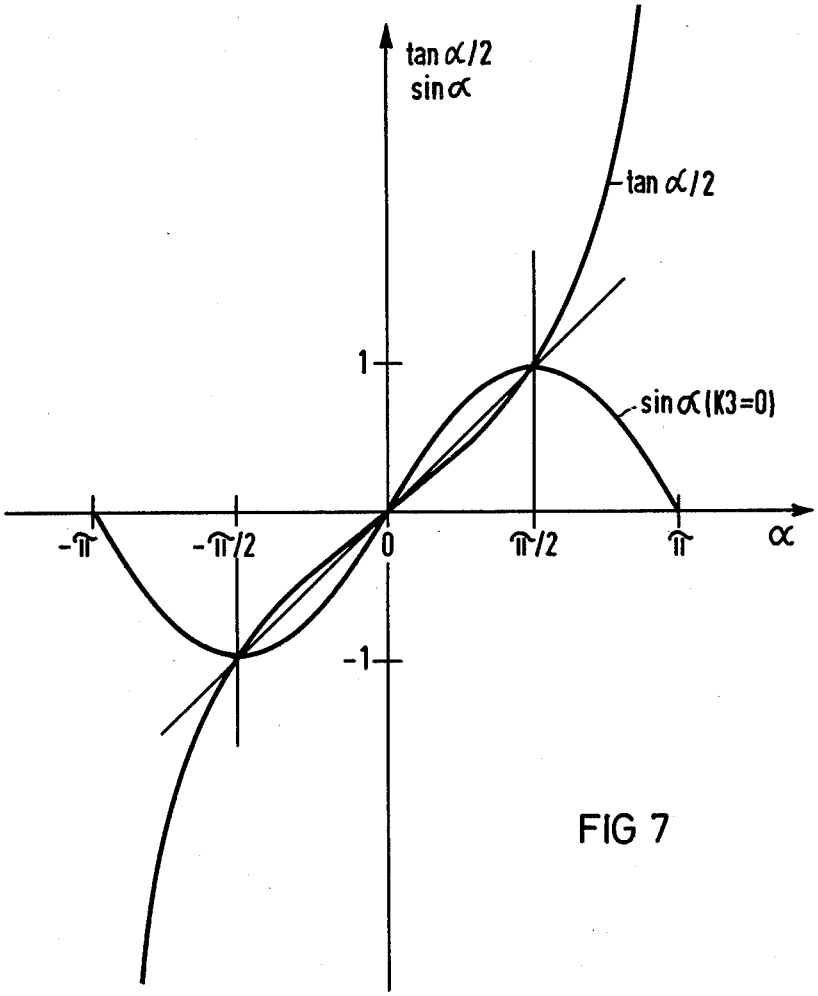
FIG. 7 illustrates two angular function curves as a function of the angle.

The factors K1, K2, and K3 are selectable constants. The constant K3 is smaller than or equal to 1, and the constants K1 and K2 are normalized factors. The relation (11) is an approximate expression for the angle $\alpha$, forming a mean value d from two angular functions. One angular function is given by the first term, namely tan $\alpha/2$. It is almost linear when the arguments $\alpha/2$ are small and has a monotonically increasing slope as the arguments $\alpha/2$ become greater. The other angular function is given by the second term of equation (11). For the special case K3=0 it corresponds to sin $\alpha$. In this angular function, a likewise nearly linear range for small arguments $\alpha$ is followed by a range with monotonically decreasing slope for larger arguments $\alpha$. Both angular functions are shown in FIG. 7. By appropriately weighting the mean value of both angular functions it is possible to provide that the linearity deviations largely cancel each other over a wide range of the angle $\alpha$.

Three possible combinations are given below.

Case 1

For K1=0.707, K2=0.293, and K3=0, for example, the relation (11) results in quantity d for the angle $\alpha$ in the angular range from $-90°$ to $+90°$, between d=−1 and d=+1, with a maximum error of ±0.5°.

Case 2

When K1=0.516, K2=0.280, and K3=0 are selected, for example, the angular range increases to between $\alpha = -110°$ and $\alpha = +110°$. The quantity then is between d=−1 and d=+1 and has a maximum error of ±1.6°.

Case 3

For K1=0.291, K2=0.365, and K3=0.400, for instance, an operating range between $\alpha = -130°$ and $\alpha = +130°$ is reached, the quantity d being between d=−1 and d=+1. The maximum angular error here amounts to ±2.5°.

Which one of these three possibilities to choose or whether to give the factors K1, K2, and K3 different values depends on the requirements of the individual case.

Figure 8:
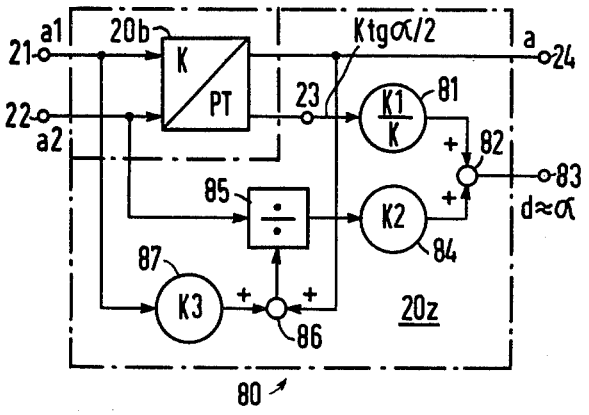
FIG. 8 is a block diagram of a coordinate converter, consisting of a basic unit and an ancillary unit.

FIG. 8 shows an implementation of the relation (7) in a block diagram. In it, a K/TP coordinate converter 20b serves as the basic unit and, together with ancillary unit 20z forms K/P converter 80. The values to be selected for the coordinate converter 20b are K=1 in Case 1, K≦0.7 in Case 2, and K≦0.466 in Case 3.

In detail, FIG. 8 shows the third variable Ktan $\alpha/2$ taken from output terminal 23 of unit 20b and fed, via a proportional element 81 having the proportionality factor K1/K, to one input of adder 82. To a second input of adder 82 is applied, via a proportional element 84 having the proportionality factor K2, the output of another divider 85. The fifth variable d, which is to a large extent proportional to the angle $\alpha$, is taken from output terminal 83 at the output of adder 82. The second variable a2 is supplied to the dividend input of the other divider 85 and the output variable of a fourth adder 86 to the divisor input. To this fourth adder 86 is applied, in turn, the fourth variable a, on the one hand, and, via a fifth proportional element 87 having proportionality constant K3, the first variable a1, on the other hand. The proportionality constants K1, K2, and K3 are selected in accordance with considerations discussed above.

The circuit of ancillary unit 20z is shown in the part of FIG. 4 not yet discussed. Again operational amplifiers are used. The size of the various resistors is indicated in reference to a basic unit R. As shown, one series input resistor of adder 82 should be made K·R/K1 and the other series input resistor, R/K2. These resistors correspond to the proportional elements 81 and 84, respectively, of FIG. 8. The additional divider 85 is also an operational amplifier having a feedback path containing a multiplier and a resistor connected in series. To the other input of this multiplier is applied, with sign reversed, the output of fourth adder 86. The resistance of one series input resistor of adder 86 is equal to R, and the resistance of the series input resistor to which the first variable a1 is supplied is equal to R/K3. The latter series resistance thus corresponds to fifth proportional element of FIG. 8.

Figure 9:
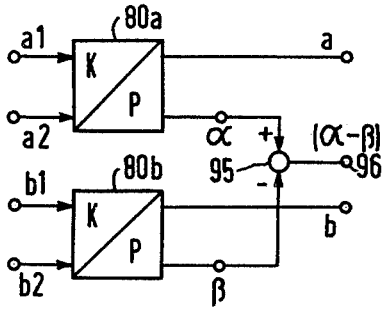
FIG. 9 is a block diagram showing the interconnection of two coordinate converters of the type shown in FIG. 8.

It is evident from FIG. 9 that the already described problem of forming the difference between a reference and an actual angular value can be solved with two such K/P converters 40 or 80, and that, without operating-point-dependent amplification change.

According to FIG. 9, two coordinate converters 80a and 80b such as those of FIG. 8 are interconnected. The two variables $\alpha$ and $\beta$ are fed to a subtractor 95, at whose output terminal 96 appears the output variable $(\alpha - \beta)$ as the value representing the difference of the angles $\alpha, \beta$ of the two given vectors $\vec{a}, \vec{b}$. In contrast to the circuit according to FIG. 6 with K/PT converters, the angular difference here need not vary around zero in order to be linear, but may assume any value. Therefore, any angular differences $(\alpha - \beta)$ can be formed. When an adder is used instead of the subtractor 95, any angular sums can be formed also.

A coordinate converter 40 (FIG. 4) or 80 (FIG. 8) may also be succeeded by a differentiator, (not shown), and the time derivative $\dot{\alpha}$ of an angle $\alpha$ determined in this manner.

Figure 10:
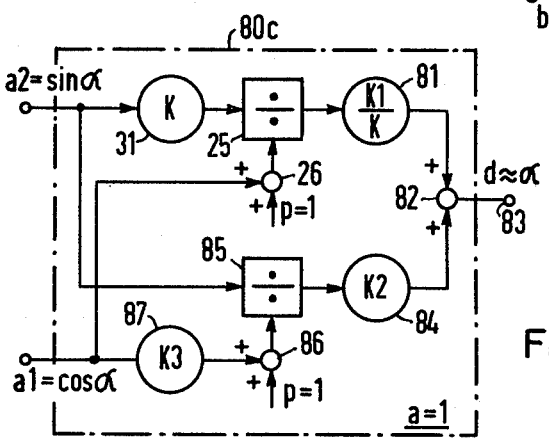
FIG. 10 is a block diagram of an embodiment of a coordinate converter according to the invention in which the magnitude a=1.
Figure 11:
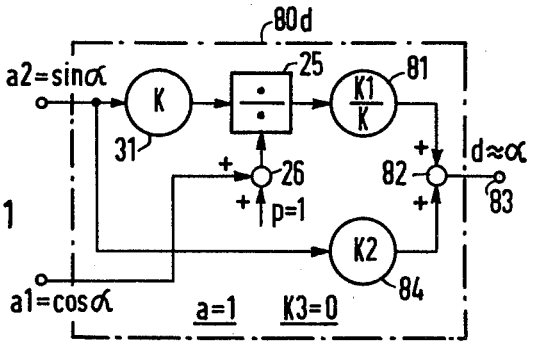
FIG. 11 is a block diagram of a coordinate converter according like that of FIG. 10 in which the third proportional constant is zero.

Shown in FIGS. 10 and 11 are two special cases of a K/P converter. If the vector $\vec{a}$ to be converted is a unit vector, such as when represented by the two output signals of a vector analyzer, then we have a=1, and the magnitude-forming section of coordinate converter 80 in FIG. 8 can be omitted. Then, for the above-mentioned Case 3, the coordinate converter 80 of FIG. 8 is reduced to the coordinate converter 80c shown in FIG. 10. In the diagrams of FIGS. 10 and 11 the same reference symbols are used as in the preceding drawings.

According to FIG. 10, the output of the divider 25 is applied to one input of an adder 82 via proportional element 81 having the proportionality constant K1/K. To the dividend input of divider 25, the second variable a2 is fed via the proportional element 31 having constant K; the output signal of first adder 26 is applied to the divisor input. The first variable a1, on the one hand, and a constant p=1, on the other hand, are supplied to adder 26. The second input of adder 82 receives the output of divider 85 via the proportional element 84 having constant K2. To the dividend input of divider 85 is applied the second variable a2, and, to the divisor input, the output variable of adder 86. To the latter is applied, in turn, via the proportional element 87 having constant K3, the first variable a1, on the one hand, and a constant p=1, on the other hand.

The coordinate converter 80*d* of FIG. 11 is used when K3=0; see above, Case 1 and Case 2. The components 85 to 87 of FIG. 10 are omitted here, and the second variable a2 is applied directly to the proportional element 84.

Figure 12:
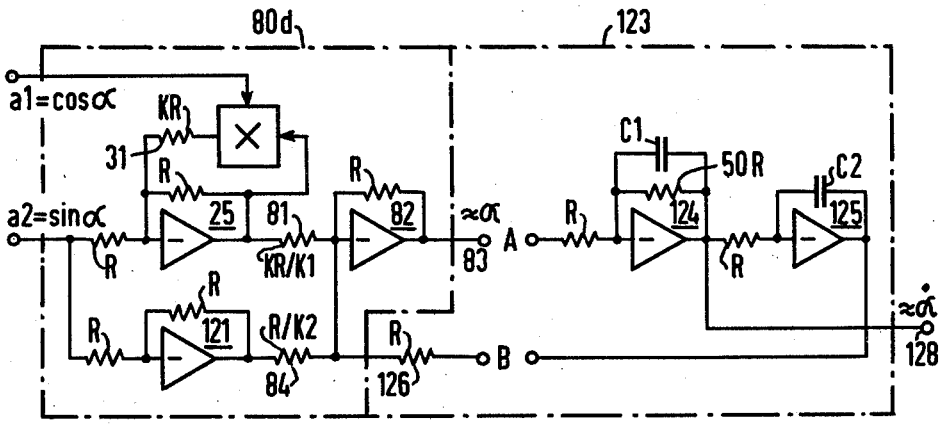
FIG. 12 is a schematic diagram of the coordinate converter of FIG. 11 followed by a divider, showing the individual the modules.

FIG. 12 is a circuit diagram of the coordinate converter 80*d* of FIG. 11; it is again constructed of a number of operational amplifiers. The two factors K1 and K2 are set in the manner previously disccused, by means of resistors which serve as proportional elements 81 and 84, respectively. A phase-inverter amplifier 121 preceding the proportioner 84 is provided for signal processing.

As may further be seen from FIG. 12, the output terminal 83 of coordinate converter 80*d* is followed by a differentiator 123. It consists of a bridgeable gap A, a succeeding operational amplifier 124 having a high resistance (e.g., a resistance of the order of 50 R), and a capacitor C1 of small capacitance connected in parallel in the amplifier's feedback path, followed by another integrating operational amplifier 125 having an integrator capacitor C2 in its feedback path, followed in turn, by a gap B and another series resistor 126 connected to the input of adder 82. When the gaps A and B are open, a variable d proportional to the angle $\alpha$ can be taken off the output terminal 83. When gaps A and B are both closed, a variable proportional to the variation in time $\dot{\alpha}$, of the angle $\alpha$, can be taken off at output terminal 128 of operational amplifier 124.

So far, the premise has been that the vector $\vec{a}$ and/or $\vec{b}$ to be converted is a nonrotating vector. But if the vector $\vec{a}$ of FIG. 1 is a rotating vector, the left half-plane of the diagram can be mirrored in the right half-plane by rectification of the first variable a1. When the K/P converter 80 (at K=1) operates only in the range from −90° to +90°, when a rotating vector $\vec{a}$ is involved. The mirrored vector $\vec{a}'$ has the same magnitude a as the vector $\vec{a}$; but its angular velocity $\dot{\alpha}$ is opposed to that of vector $\vec{a}$.

Figure 13:
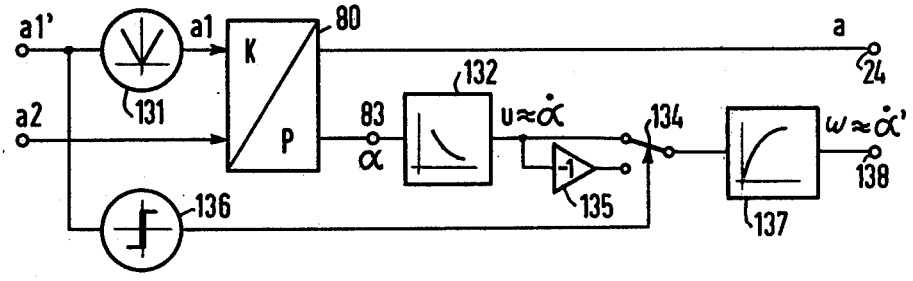
FIG. 13 is a block diagram illustrating the application of a coordinate converter to a rotating vector in accordance with the teachings of the invention.

In the circuit of FIG. 13 it is possible to determine the magnitude a and, at the same time, a variable $\omega$ of a rotating vector $\vec{a}$ proportional to the actual angular velocity $\dot{\alpha}'$. Here again, a coordinate converter 80 of the design already described is used. According to the present assumptions, the first variable a1′ (like the second variable a2) may here by of either polarity. It is transformed by means of a rectifier 131 into the unipolar (only positive) first variable a1. In this case, the magnitude a is again present directly at output terminal 24 of the K/P converter 80. The angular velocity $\dot{\alpha}'$ is obtained through an input-controlled inversion (input-oriented inverter operation) of the differentiated angular variable $\dot{\alpha}$. For this purpose, a differentiator 132 is connected to converter output terminal 83 and followed by inverter circuit 134, 135. This involves essentially a double-throw switch 134 by mans of which the output variable u of the differentiator 132, which is proportional to an auxiliary angle velocity $\dot{\alpha}$, is passed on directly or after polarity reversal in inverter 135. Operation of double-throw switch 134 is controlled by multivibrator 136 which determines the sign of the first variable a1′, as a function of the polarity of the bipolar first variable a1′. Connected to the switch bar of double-throw switch 134 is smoothing member 137, from whose output 138 the variable $\dot{\alpha}$, proportional to the angular $\omega$, is taken. If the actual angular velocity $\alpha$ is constant, the variable $\omega$ proportional to it is a constant quantity, whereas the output variable u is an alternating quantity.

What is claimed is:

1. A coordinate converter for changing first and second given variables, corresponding to the Cartesian coordinates of a vector, into at least one third variable corresponding to the angle coordinate of the vector represented in polar coordinates, for the case where the magnitude coordinate of the input vector represented in polar coordinates is constant, comprising:

a first divider having a dividend input, a divisor input and an output;

a first adder having two inputs and an output;

a second adder having two inputs and an output; and first, second and third proportional members;

in which the second variable is fed to the dividend input of the first divider via the first proportional member and the output signal of the first adder is fed to the divisor input of the first divider; the first variable and a constant are applied to the first adder; the output signal of the first divider is fed to the second adder via the second proportional member, and a signal derived from the second variable is fed to the second adder via the third proportional member; and the output variable of the second adder is taken off as an angle variable.

2. A coordinate converter in accordance with claim 1, in which the second variable is fed directly to the second adder via the third proportional member.

3. A coordinate converter in accordance with claim 1, further comprising:

a third adder having two inputs and an output;

a fourth proportional member; and a second divider having a divisor input, a dividend input, and an output;

in which the second variable is fed to the dividend input of the second divider;

the output signal of the third adder is applied to the divisor input of the second divider;

a constant is fed to one input of the third adder; and the first variable is fed to another input of the third adder via the fourth proportional member.

4. A coordinate converter, in accordance with claim 1, for conversion of the coordinates of a rotating vector expressed in Cartesian coordinates into at least one signal, as a variable proportional to the angle coordinate of the rotating vector represented in polar coordinates, in which one variable of the vector to be converted is a bipolar signal, comprising:

a rectifier having an input to which the bipolar first variable is applied, and an output coupling a unipolar first variable to the converter as the first input signal.

5. A coordinate converter, in accordance with claim 4, for producing a signal proportional to the angular velocity of the rotating vector, further comprising:

a differentiator having an input coupled to the output of the third adder at which the signal proportional to the angle coordinate of the vector is taken off; and an input-controlled inverter having an input coupled to the output of the differentiator and an output at which the signal proportional to the difference in angular velocities between the rotating vectors is taken off, the inverter being responsive to the polarity of the bipolar first variable to invert the differentiated signal.

6. A coordinate converter for changing first and second signals, as variables corresponding to the Cartesian coordinates of a vector, into at least one signal, as a variable, proportional to the angle coordinate of the vector represented in polar coordinates, comprising:

a first divider having a divisor input, a dividend input, and an output;

a first adder having at least two inputs and an output;

a multiplier having a first input, a second input, and an output;

a second adder having a least two inputs and an output;

first and second proportional elements;

third and fourth adders, each having a first input, a second input and an output;

third, fourth, and fifth proportional elements; and a second divider having a divisor input, a dividend input, and an output;

in which the second signal is fed to the dividend input of the first divider via the first proportional element and the signal at the output of the first adder is fed to the divisor input of the first divider;

the first signal and the signal at the output of the second adder are fed to inputs of the first adder;

the signal at the output of the first divider represents a third variable and is fed to the first input of the multiplier;

the second signal is fed to the second input of the multiplier;

the first signal is fed to the first input of the second adder;

the signal at the output of the multiplier is fed via the second proportional element to the second input of the second adder;

the output signal of the second adder is taken off as a fourth variable corresponding to the magnitude coordinate of the vector fixed in polar coordinates;

the signal representing the third variable is fed to the first input of the third adder via the third proportional element;

the output of the second divider is fed via the fourth proportional element to the second input of the third adder;

the output of the fourth adder is supplied to the divisor input of the second divider;

the second variable is applied to the dividend input of the second divider;

the signal representing the fourth variable is fed to the first input of the fourth adder;

the signal representing the first variable is fed, via the fifth proportional element to the second input of the fourth adder; and a signal proportional to the angle coordinate of the vector is taken off the output of the third adder.

7. A coordinate converter, in accordance with claim 6, for conversion of the coordinates of a rotating vector expressed in Cartesian coordinates into at least one signal, as a variable, proportional to the angle coordinate of the rotating vector represented in polar coordinates, in which one variable of the vector to be converted is a bipolar signal, comprising:

a rectifier having an input to which the bipolar first variable is applied, and an output coupling a unipolar first variable to the converter as the first input signal.

8. A coordinate converter, in accordance with claim 7, for producing a signal proportional to the angular velocity of the rotating vector, further comprising:

a differentiator having an input coupled to the output of the third adder at which the signal proportional to the angle coordinate of the vector is taken off; and an input-controlled inverter having an input coupled to the output of the differentiator and an output at which the signal proportional to the difference in angular velocities between the rotating vectors is taken off, the inverter being responsive to the polarity of the bipolar first variable to invert the differentiated signal.

9. A converter for forming at least one signal as as angle-like variable corresponding to the difference between angles, expressed in polar coordinates, of first and second vectors, expressed in Cartesian coordinates, comprising:

a first coordinate converter for changing first and second input signals as variables corresponding to the Cartesian coordinates of the first vector into a first output variable corresponding to the magnitude coordinate of the first vector in polar coordinates and into a first angle-like variable, corresponding to the angle coordinate of the first vector represented in polar coordinates, comprising:

a divider having a divisor input, a dividend input, and an output, a first adder having at least two inputs and an output, a multiplier having first and second inputs and an output, and a second adder having at least two inputs and an output, in which the second signal is fed to the dividend input of the divider and the signal at the output of the first adder is fed to the divisor input of the divider, the first signal and the signal at the output of the second adder are fed to inputs of the first adder, the signal at the output of the divider is fed to the first input of the multiplier and comprises the first angle-like variable; and the second signal is fed to the second input of the multiplier, the first signal and the signal at the output of the multiplier are fed to the inputs of the second adder, and the output of the second adder comprises the first output variable;

a second coordinate converter, identical to the first coordinate converter, for changing first and second input signals as variables corresponding to the Cartesian coordinates of the second vector into a second output variable corresponding to the magnitude coordinate of the second vector in polar coordinates and into a second angle-like variable corresponding to the angle coordinate of the second vector represented in polar coordinates; and a subtractor having at least two inputs and an output, the first and second angle-like variables being fed to the inputs of the subtractor, and the output of the subtractor comprising the signal as an angle-like variable corresponding to the difference between the angles of the first and second vectors.

10. A coordinate converter in accordance with claim 9 further comprising:

a first and a second proportional element in each coordinate converter, the second input signal, in the case of the first converter, and the fourth input signal, in the case of the second converter, being fed to the dividend input of the respective divider in the respective coordinate converters via the respective first proportional element, and the output signal of the multiplier in the respective converter being fed to the respective second adder via the second proportional element.

11. A converter, in accordance with claim 9, for forming at least one signal as an angle-like variable corresponding to the difference between angles, expressed in polar coordinates, of first and second rotating vectors, expressed in Cartesian coordinates, in which one variable of each vector is a bipolar signal, comprising:

first and second rectifiers, each having an input for receiving the respective bipolar signal, and each having an output coupling a unipolar first variable to the respective converter as the first input signal.

12. A converter in accordance with claim 11, for producing a signal proportional to the difference in angular velocities between the rotating vectors, further comprising:

first and second differentiators, each coupled to the output at which the variable proportional to the angle coordinate is taken off of the respective converter; and first and second input-controlled inverters, each interposed between the output of one differentiator and one input of the subtractor and each responsive to the polarity of the respective bipolar first variable to invert the respective differentiated signal, the output of the subtractor being taken off as a signal proportional to the difference in angular velocity between the rotating vectors.

13. A coordinate converter for conversion of a rotating vector expressed as first and second signals, as variables corresponding to the Cartesian coordinates of the vector, into at least one signal, as a third, angle-like, variable corresponding to the angle coordinate of the vector represented in polar coordinates, comprising:

a rectifier having an input to which a bipolar first variable is applied and an output at which a unipolar first variable is taken off;

a divider having a divisor input, a dividend input, and an output;

a first adder having at least two inputs and an output;

a multiplier having first and second inputs and an output; and a second adder having at least two inputs and an output;

the second signal being fed to the dividend input of the divider and the signal at the output of the first adder being fed to the divisor input of the divider;

the unipolar first variable signal and the signal at the output of the second adder being fed to inputs of the first adder;

the signal at the output of the divider being taken off as the third variable and being fed to the first input of the multiplier;

the second signal being fed to the second input of the multiplier;

the unipolar first variable signal and the signal at the output of the multiplier being fed to the inputs of the second adder; and the output signal of the second adder being taken off as a fourth variable corresponding to the magnitude coordinate of the vector fixed in polar coordinates.

14. A coordinate converter in accordance with claim 13, further comprising:

first and second proportional elements, the second signal being fed to the dividend input of the divider via the first proportional element and the output signal of the multiplier being fed to the second adder via the second proportional element.

15. A coordinate converter in accordance with claim 13, further comprising:

a differentiator having an input to which the third variable from the output of the divider is fed and having an output; and an input-controlled inverter coupled to the output of the differentiator and responsive to the polarity of the bipolar first variable for inverting the differentiated signal, the inverter having an output at which a signal proportional to the angular velocity of the vector is taken off.

16. A coordinate converter for forming a signal representing the difference between the angles, expressed in polar coordinates, of first and second vectors, expressed in Cartesian coordinates, comprising:

first and second converters, each comprising;

a first divider having a divisor input, a dividend input, and an output;

a first adder having at least two inputs and an output;

a multiplier having a first input, a second input, and an output;

a second adder having at least two inputs and an output;

first and second proportional elements;

third and fourth adders, each having a first input, a second input and an output;

third, fourth, and fifth proportional elements; and a second divider having a divisor input, a dividend input, and an output;

in which the second signal is fed to the dividend input of the first divider via the first proportional element and the signal at the output of the first adder is fed to the divisor input of the first divider;

the first signal and the signal at the output of the second adder are fed to inputs of the first adder;

the signal at the output of the first divider represents a third variable and is fed to the first input of the multiplier;

the second signal is fed to the second input of the multiplier;

the first signal is fed to the first input of the second adder;

the signal at the output of the multiplier is fed via the second proportional element to the second input of the second adder;

the output signal of the second adder is taken off as a fourth variable corresponding to the magnitude coordinate of the vector fixed in polar coordinates;

the signal representing the third variable is fed to the first input of the third adder via the third proportional element;

the output of the second divider is fed via the fourth proportional element to the second input of the third adder;

the output of the fourth adder is supplied to the divisor input of the second divider;

the second variable is applied to the dividend input of the second divider;

the signal representing the fourth variable is fed to the first input of the fourth adder;

the signal representing the first variable is fed, via the fifth proportional element to the second input of the fourth adder;

a signal proportional to the angle coordinate of the vector being taken off the output of the third adder; and a subtractor having two inputs and an output;

first and second signals, as variables representing the Cartesian coordinates of the first vector, being fed to the first converter;

first and second signals, as variables representing the Cartesian coordinates of the second vector, being fed to the second converter;

the signal proportional to the angle coordinate of the vector is fed from the output of each third adder to one input of the subtractor; and a signal proportional to the difference of the angles of both vectors, being taken off at the output of the subtractor.

17. A converter, in accordance with claim 16, for forming at least one signal as an angle-like variable corresponding to the difference between angles, expressed in polar coordinates, of first and second rotating vectors, expressed in Cartesian coordinates, in which one variable of each vector is being converted is a bipolar signal, comprising:

first and second rectifiers, each having an input for receiving the respective bipolar signal and each having an output coupling a unipolar first variable to the respective converter as the first input signal.

18. A converter in accordance with claim 17, for producing a signal proportional to the difference in angular velocities between the rotating vectors, further comprising:

first and second differentiators, each coupled to the output at which the variable proportional to the angle coordinate is taken off of the respective converter; and first and second input-controlled inverters, each interposed between the output of one differentiator and one input of the subtractor and each responsive to the polarity of the respective bipolar first variable to invert the respective differentiated signal, the output of the subtractor being taken off as a signal proportional to the difference in angular velocity between the rotating vectors.

* * * * *